US006271466B1

(12) United States Patent
Tsuneoka et al.

(10) Patent No.: US 6,271,466 B1
(45) Date of Patent: Aug. 7, 2001

(54) GROUNDING CABLE

(75) Inventors: Masaki Tsuneoka; Yoshinao Okawa, both of Ibaraki; Yoshihiro Murano; Kenichi Okada, both of Tokyo, all of (JP)

(73) Assignees: Japan Atomic Energy Research Institute; Kandenko Co., Ltd., both of Tokyo; Mitsubishi Cable Industries, Ltd., Hyogo, all of (JP)

( * ) Notice: Subject to any disclaimer, the term of this patent is extended or adjusted under 35 U.S.C. 154(b) by 0 days.

(21) Appl. No.: 09/413,245

(22) Filed: Oct. 7, 1999

(30) Foreign Application Priority Data

Oct. 9, 1998 (JP) ..... 10-301754

(51) Int. Cl.[7] ..... H01B 11/06; H01B 7/18
(52) U.S. Cl. ..... 174/36; 174/102 R; 174/102 SP
(58) Field of Search ..... 174/36, 110 R, 174/102 R, 102 SC, 102 C, 102 SP

(56) References Cited

U.S. PATENT DOCUMENTS

| | | | | |
|---|---|---|---|---|
| 3,643,007 | * | 2/1972 | Roberts et al. | 174/106 |
| 4,301,428 | * | 11/1981 | Mayer | 333/12 |
| 4,383,225 | * | 5/1983 | Mayer | 333/12 |
| 4,408,089 | * | 10/1983 | Nixon | 174/34 |
| 4,822,950 | * | 4/1989 | Schmitt | 174/36 |
| 4,960,965 | * | 10/1990 | Redmon et al. | 174/102 R |
| 5,008,488 | * | 4/1991 | Nakagawa | 174/36 |
| 5,171,938 | * | 12/1992 | Katsumata et al. | 174/36 |
| 5,394,507 | * | 2/1995 | Okamoto | 392/480 |

OTHER PUBLICATIONS

Electrical Engineering Pocketbook, ed. The Institute of Electrical Engineers of Japan, 1987, p. 148.
Hans C. Ohanian, Physics, Union College and Rensselaer Polytechnic Institute, W. W. Norton & Company, 1985, p. 763.

* cited by examiner

*Primary Examiner*—Dean A. Reichard
*Assistant Examiner*—William H Mayo, III
(74) *Attorney, Agent, or Firm*—Wenderoth, Lind & Ponack, L.L.P.

(57) ABSTRACT

A method of preventing a high-frequency noise generated in an electronic device, remaining in a grounding cable as a standing wave and transmitted to electric devices, is disclosed, which method including disposing, directly or via an insulating layer, a non-metallic conductive material having a slight electric resistance, on a conductor of the above-mentioned grounding cable, making the electric resistance of the non-metallic conductive material consume the high-frequency noise flowing on the conductor surface of the grounding cable by virtue of a skin effect, whereby resonance of the high-frequency noise is reduced. Resonance of the high-frequency noise generated from various electronic devices in an office building and the like can be easily reduced. Consequently, various disadvantages due to high-frequency noise can be avoided. In addition, the slight electric resistance R of the non-metallic conductive material and inductance L of the metal conductor are set to satisfy the formula: $2\pi fL/R \leqq 1$, so that the resonance of a high-frequency noise can be reduced.

6 Claims, 6 Drawing Sheets

GROUNDING CABLE

TECHNICAL FIELD OF THE INVENTION

The present invention relates to a method of preventing a high-frequency noise on a grounding cable for the purpose of reducing damages caused by a high-frequency noise generated in electronics such as OA (office automation) equipment used in office buildings, and to a cable used for this end.

BACKGROUND OF THE INVENTION

In modern office buildings, networking is predominant and internet has been actively used. Inevitably, electronic instruments such as personal computers and the like are used in numbers. High frequency noise is generated not only from these electronic instruments but also from other equipment generally referred to as electronics. Since this high-frequency noise causes various types of damage to the above-mentioned precision electronic devices, countermeasures have been recently taken such as attaching a shield against radiation noise of the electronic device itself and installing a noise cut transformer against a conduction noise. In general, connection to a grounding cable of a grounding electrode having a low impedance to a high-frequency wave, from among the grounding electrodes set in office buildings at the time of construction, is considered to be sufficient for the removal of high-frequency noise.

This high-frequency noise does not disappear into the earth through a grounding cable, but in fact remains in the grounding cable as a standing wave of a high-frequency noise having various frequencies and greater amplitude than the initial amplitude, due to repeat reflection between the grounding electrode side and the electronic instrument side of the grounding cable.

A high-frequency noise remaining on a grounding cable as such standing wave flows into electronic devices to cause malfunction of or damage to the devices, thereby causing serious problems in offices.

The present invention provides a method for easily reducing or eliminating a standing wave generated on a grounding cable by modifying the grounding cable such that a high-frequency noise does not remain as a standing wave on the grounding cable, and a cable constitution therefor.

SUMMARY OF THE INVENTION

In general terms, when the current flows in a metal conductor, a low-frequency wave at a commercial frequency and the like flows in the metal conductor, whereas a high-frequency noise tends to flow on the surface of a metal conductor by virtue of a skin effect phenomenon.

It has been known that, of the aforementioned high-frequency noises having various frequencies, a high-frequency noise having a maximum amplitude called resonance causes substantial damages to electronic devices.

In the present invention, therefore, the resonance of the high-frequency noise is reduced by forming a resistor having a small electric resistance on the surface of a metal conductor of a grounding cable such that, of the high-frequency noises flowing on the surface of the metal conductor, particularly the high-frequency noise, which produces resonance, is consumed when flowing through the electric resistor. The constitution of the present invention is explained in detail in the following.

A first aspect of the invention is a method of preventing a high-frequency noise that is generated in an electronic device, remains in a grounding cable as a standing wave, and is transmitted to electric devices, the method comprises disposing, directly or via an insulating layer, a non-metallic conductive material having a slight electric resistance on a conductor of the above-mentioned grounding cable, and making the electric resistance of the non-metallic conductive material consume the high-frequency noise flowing on a surface of the conductor of the grounding cable by virtue of a skin effect, whereby resonance of the high-frequency noise is reduced.

A second aspect of the invention is the method according to the first aspect wherein an electric resistance R of the non-metallic conductive material and an inductance L of the conductor of the grounding cable having the conductive material satisfy the formula: $2\pi fL/R \leqq 1$ wherein f is a resonance frequency of the high-frequency noise.

A third aspect of the invention is the method according to the first aspect, wherein the non-metallic conductive material is disposed by coating a periphery of the conductor of the grounding cable with the non-metallic conductive material or disposing a tape-like non-metallic conductive material in the longitudinal direction of the conductor of the grounding cable.

A forth aspect of the invention is the method according to the first aspect, wherein the non-metallic conductive material is disposed by applying an insulating layer to the outside of the non-metallic conductive material.

A fifth aspect of the invention is a grounding cable for preventing a high-frequency noise that is generated in an electronic device, which remains in the grounding cable as a standing wave, and is transmitted to electric devices. The cable comprises a non-metallic conductive material, that consumes the high-frequency noise flowing on a surface of a conductor of the grounding cable with its small electric resistance by virtue of a skin effect. The non-metallic conductive material is disposed, directly or via an insulating layer, on the conductor, wherein two points spaced apart in a longitudinal direction of the conductor, the conductor and the non-metallic conductive material are electrically in contact with each other.

A sixth aspect of the invention is the cable according to the fifth aspect, wherein an electric resistance R of the non-metallic conductive material and an inductance L of the conductor satisfy the formula: $2\pi fL/R=1$ wherein f is a resonance frequency of the high-frequency noise.

A seventh aspect of the invention is the cable according to the fifth aspect, wherein the non-metallic conductive material is applied to a periphery of the conductor or disposed in a longitudinal direction of the conductor in the form of a tape.

In addition, an eighth aspect of the invention is the cable according to the fifth aspect, wherein the non-metallic conductive material comprises an insulating layer formed on the outside of the material.

DETAILED DESCRIPTION OF THE INVENTION

Figure 1:
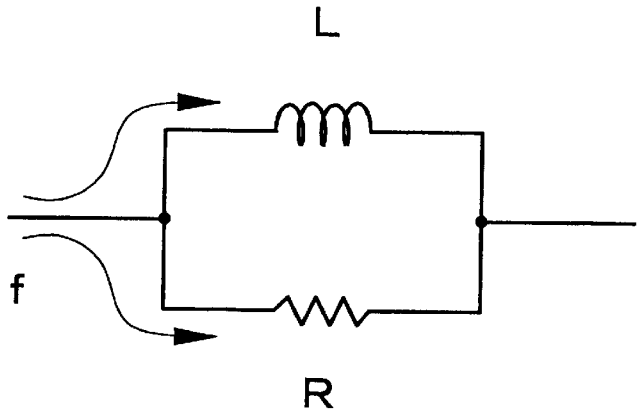
FIG. 1 is a circuit diagram showing the concept of the present invention.

FIG. 1 is a circuit diagram showing the concept of the present invention to reduce resonance of a high frequency noise. This Figure shows a model wherein a metal conductor has an inductance L and a carbon fiber having a slight electric resistance has an electric resistance R in a grounding cable comprising the carbon fiber, which is one of the non-metal conductive materials having a slight electric resistance, disposed on the surface of the metal conductor.

In this circuit diagram, a ground leakage current containing a high-frequency noise, which is generated in an electronic device, is transferred from the left to the right in the drawing. The commercial frequency wave in the ground leakage current flows through the metal conductor having an inductance L (H) and is further transferred to the right in the drawing and then transferred to the ground surface in time. In contrast, a high-frequency noise having a resonance frequency f (Hz) flows through the above-mentioned carbon fiber such that it is consumed by this electric resistance R (Ω) and reduced. At this time, electric resistance R of the carbon fiber and inductance L of the metal conductor are suitably set such that the high-frequency noise of the resonance frequency f that flows through electric resistance R of the carbon fiber and inductance L of the metal conductor satisfy the formula: $2\pi fL/R \leqq 1$. As a result, the resonance of the high-frequency noise is preferably reduced.

FIGS. 2 to 11 show specific constitution of grounding cables.

Figure 2:
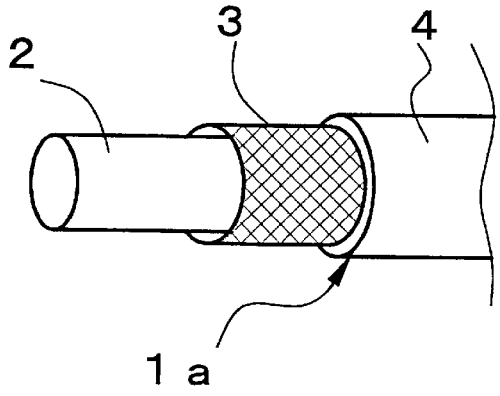
FIG. 2 illustrates the grounding cable of a first embodiment of the present invention.
Figure 3:
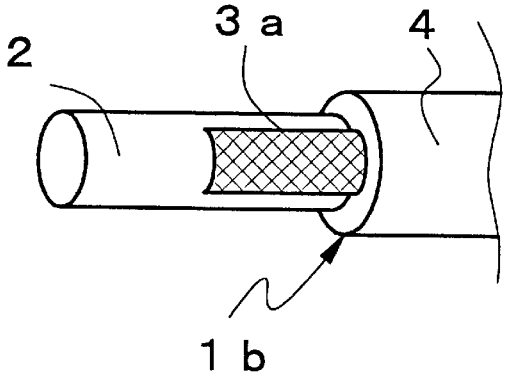
FIG. 3 illustrates the grounding cable of a second embodiment of the present invention.
Figure 4:
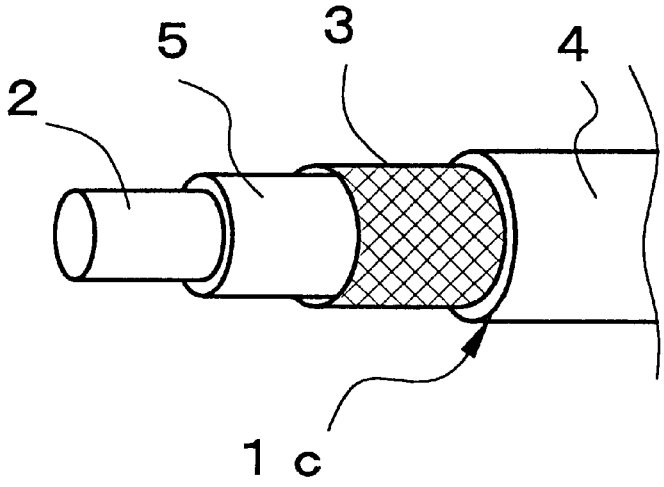
FIG. 4 illustrates the grounding cable of a third embodiment of the present invention.
Figure 5:
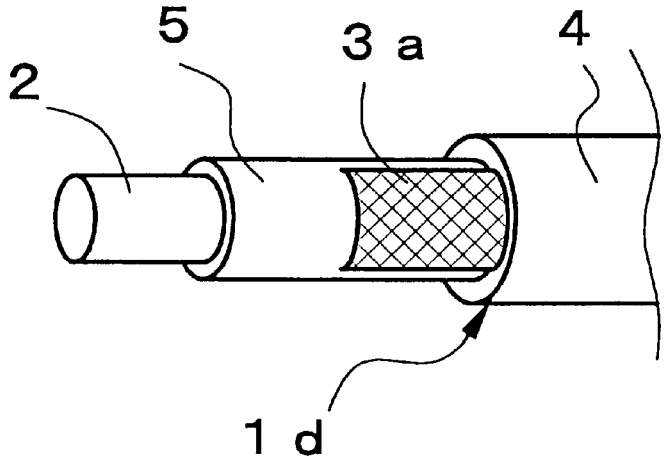
FIG. 5 illustrates the grounding cable of a fourth embodiment of the present invention.

FIG. 2 illustrates the grounding cable 1*a* of a first embodiment of the present invention, wherein a carbon fiber 3 directly covers to surround a metal conductor 2 and an outer covering layer 4 comprising an insulating layer is formed outside thereof. FIG. 3 illustrates the grounding cable 1*b* of a second embodiment of the present invention, wherein a tape-like carbon fiber 3*a* is dirt disposed on the side of the metal conductor 2 in such a manner that it follows the longitudinal direction of the metal conductor 2, and an outer covering layer 4, which is an insulating layer, is formed to cover the outside thereof. FIG. 4 illustrates the grounding cable 1*c* of a third embodiment of the present invention, wherein an insulating layer 5 surrounds the periphery of the metal conductor 2 and a carbon fiber 3 surrounds the periphery of the insulating layer 5, with an outer covering layer 4 comprising an insulating layer set on the outside thereof. FIG. 5 illustrates the grounding cable 1*d* of a fourth embodiment of the present invention, wherein an insulating layer 5 is formed to surround the periphery of the metal conductor 2, a tape-like carbon fiber 3*a* is disposed on this insulating layer 5 in the longitudinal direction of the insulating layer 5, and an outer covering layer 4 comprising an insulating layer is set on the outside thereof.

When setting these grounding cables, at least at the both ends of each cable of the grounding cables 1*a*, 1*b* and 1*c*, the metal conductor 2, and the carbon fiber 3 or tape-like carbon fiber 3*a* are electrically connected. Plural sites at suitable intervals in the longitudinal direction of grounding cables 1*a* to 1*d* are also electrically connected. As shown in FIG. 4 and FIG. 5, when an insulating layer 5 is formed to surround the metal conductor 2, the insulating layer 5 is stripped at suitable intervals in the longitudinal direction, thereby to bring the carbon fiber 3 or tape-like carbon fiber 3*a* and the metal conductor 2 into contact with each other. By controlling the intervals, the electric resistance R and inductance L of the aforementioned formula can be easily adjusted. The intervals can be controlled in a manufacturing plant before transport of the grounding cables to ground sites or may be controlled in a setting environment.

Figure 6:
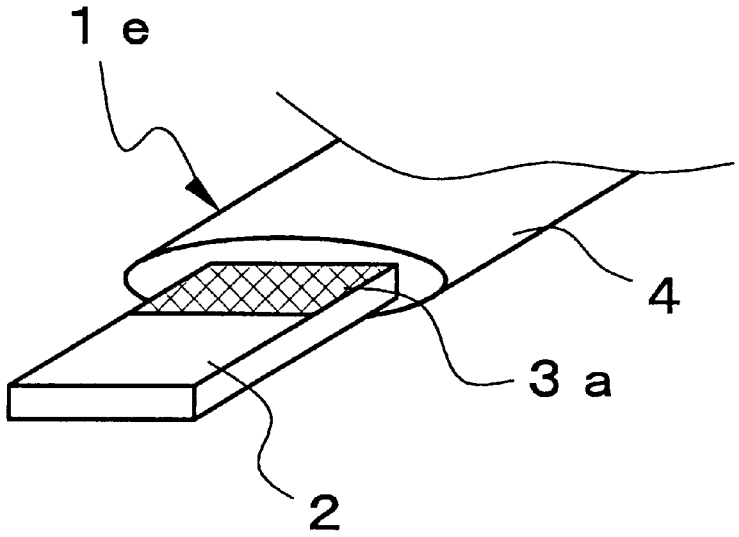
FIG. 6 the grounding cable of a fifth embodiment of the present invention.
Figure 7:
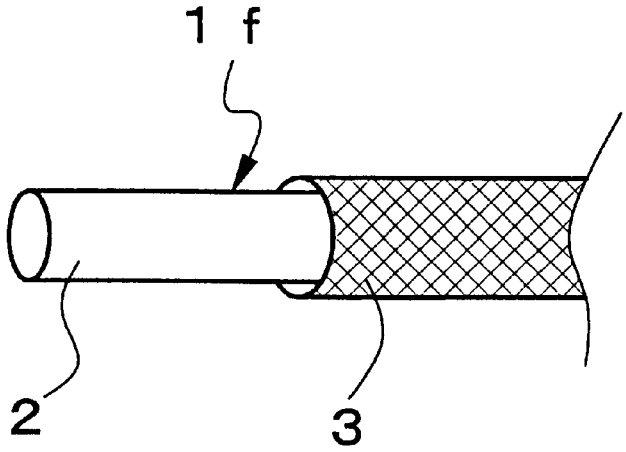
FIG. 7 illustrates the grounding cable of a sixth embodiment of the present invention.
Figure 8:
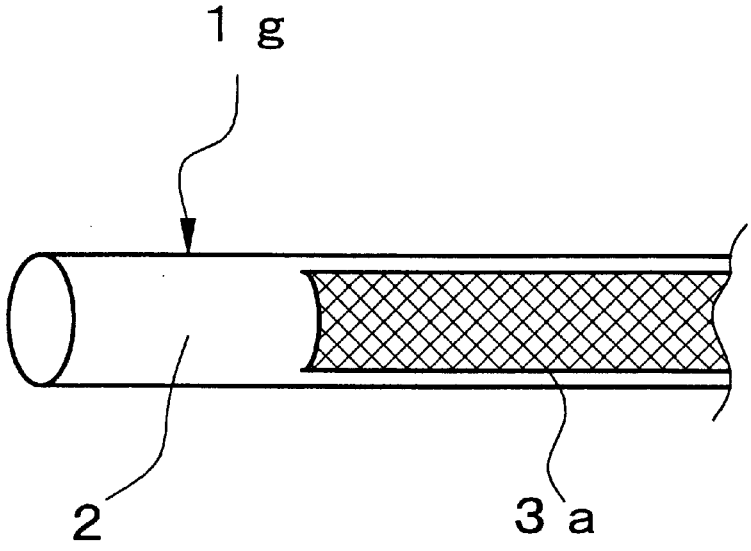
FIG. 8 illustrates the grounding cable of a seventh embodiment of the present invention.

FIG. 6 illustrates the grounding cable 1*e* of a fifth embodiment of the present invention, wherein the grounding cable 1*e* is a flat type cable, a tape-like carbon fiber 3*a* is directly disposed on one plane of a low profile metal conductor 2, and an outer covering layer 4 comprising an insulating layer is applied to cover the outside thereof. FIGS. 7 and 8 show the grounding cables 1*f* and 1*g* that are the sixth embodiment and the seventh embodiment, respectively, of the present invention. They are bare conductors without an outer covering layer 4. Like FIG. 2 and FIG. 3, the sixth embodiment comprises a carbon fiber 3 directly surrounding the periphery of the metal conductor 2, and the seventh embodiment comprises the tape-like carbon fiber 3*a* direct disposed on the side of metal conductor 2 in the longitudinal direction of the metal conductor 2.

Figure 9:
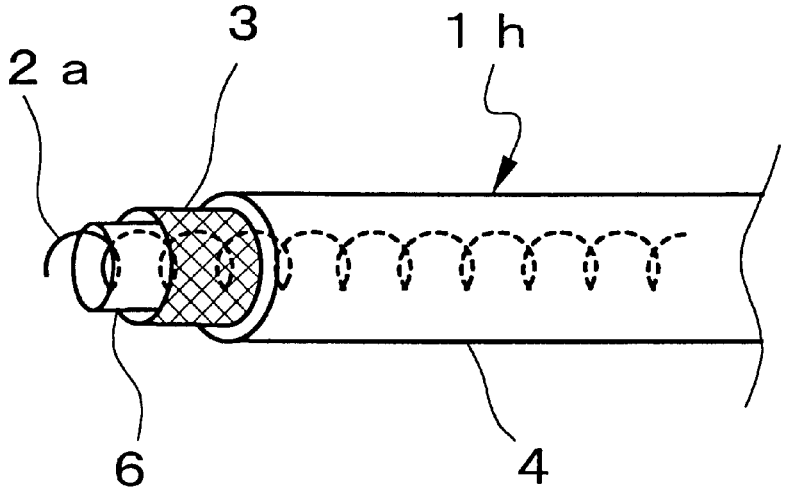
FIG. 9 illustrates the grounding cable of an eighth embodiment of the present invention.
Figure 10:
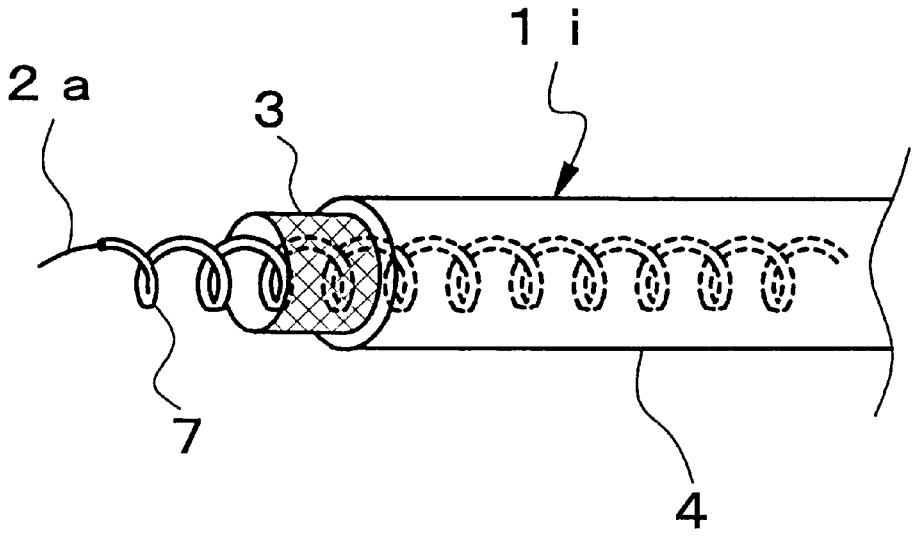
FIG. 10 illustrates the grounding cable of a ninth embodiment of the present invention.

FIG. 9 and FIG. 10 show grounding cables 1*h* and 1*i* which are the eighth embodiment and the ninth embodiment, respectively, of the present invention. The grounding cables 1*a* to 1*g* as shown in the above-mentioned FIGS. 2 to 8 are characterized by the internal inductance L of the metal conductor and electric resistance R of the carbon fiber. In contrast, these are characterized by the combination of the external inductance of the metal conductor and electric resistance R of the carbon fiber 3. That is, the grounding cable 1*h* of the eighth embodiment comprises a metal conductor 2*a* (inductance L) having a coil-like shape, which is embedded in a tubular solid body 6 consisting of an insulating layer, a carbon fiber 3 surrounding the periphery of this solid body 6, and an outer covering layer 4 consisting of an insulating layer which surrounds the periphery of this carbon fiber 3. The grounding cable 1*i* of the ninth embodiment has a structure wherein a carbon fiber 3 surrounds the periphery of the coil-like metal conductor 2*a* covered with the insulator 7, and the outer covering layer 4 consisting of an insulating layer surrounds the periphery thereof.

Figure 11:
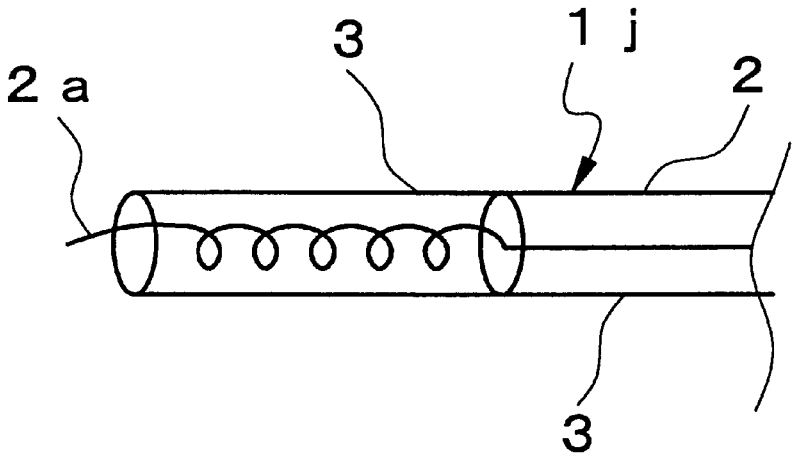
FIG. 11 illustrates the grounding cable of a tenth embodiment of the present invention.

In these cases, the values of the inductance L and the electric resistance R are set to satisfy the formula $2\pi fL/R \leqq 1$. By the use of the coil-like metal conductor 2*a*, the value of inductance L can be increased. FIG. 11 illustrates the grounding cable of a tenth embodiment of the present invention, which is a combination of one of the structures of the above-mentioned first embodiment to the seventh embodiment and the structure of the eighth embodiment or the ninth embodiment to give the grounding cable 1*j*. The metal conductor has been coiled as in these ninth and tenth embodiments because the condensation and rarefaction of the coiling enables control of inductance L to satisfy the above-mentioned formula: $2\pi fL/R \leqq 1$ with ease.

Figure 12:
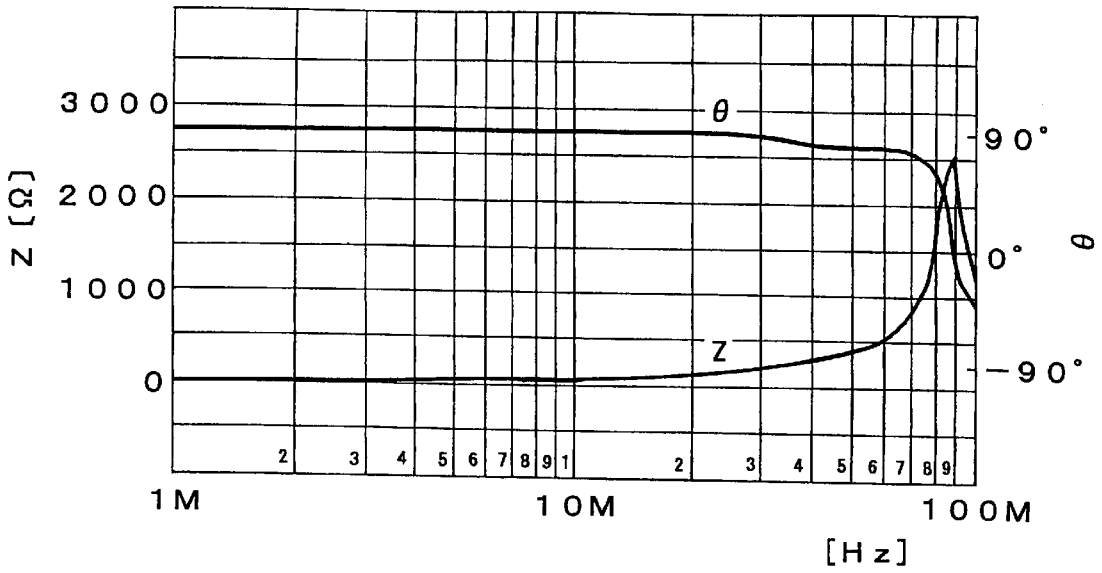
FIG. 12 is a graph showing the measurement values of high-frequency impedance when a conventional grounding cable was used.
Figure 13:
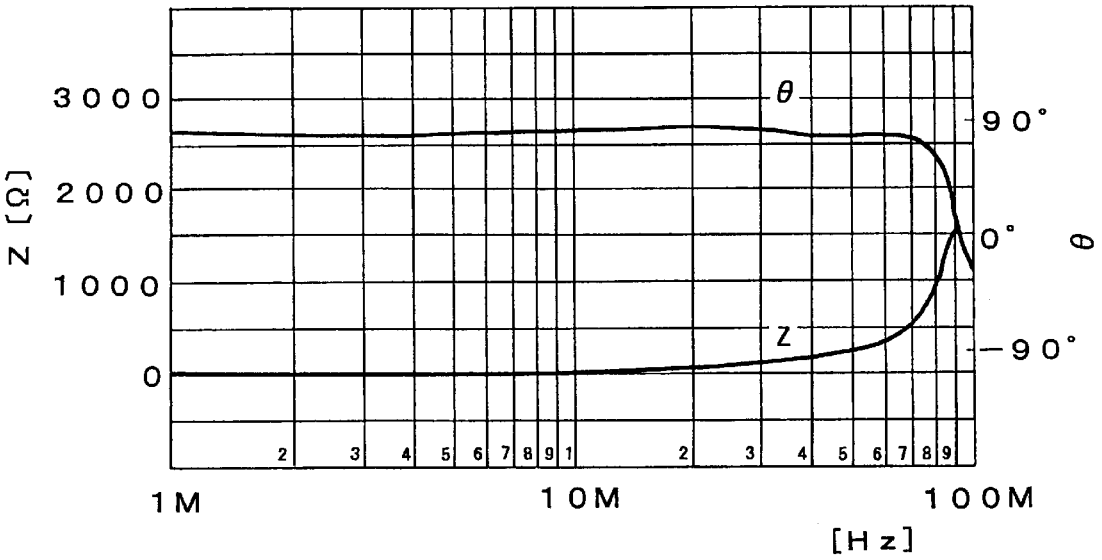
FIG. 13 is a graph showing the measurement values of high-frequency impedance when the grounding cable of the fourth embodiment of the present invention was used.

To demonstrate that a grounding cable having the constitution of the present invention actually reduces high-frequency noise, a cable comprising a carbon fiber (TORAYCA cloth CO6644B, trademark, manufactured by Toray Industries, Inc.) and a conventional cable were compared by measuring the high-frequency impedance. Using 1 m of a conventional cable (5.5 $mm^2$) and 1 m of the grounding cable 1*d* of the present invention having the constitution shown in FIG. 5, conductors at the both ends of the cable were connected to an impedance analyzer (manufactured by Hewlett Packard 4194A). FIG. 12 shows the results of the conventional grounding cable. FIG. 13 shows the results of the measurement of the grounding cable 1*d* of the preset invention. The abscissa of these FIGS. 12 and 13 is frequency (Hz) and the ordinate is impedance (Ω).

In FIG. 12, impedance Z shows a peak at around 90 MHz, whereas in FIG. 13, the impedance Z at the same point is reduced to about 60%. This means that the conventional grounding cable generated a standing wave of a high-frequency noise by repeat reflection of the high-frequency wave between the both ends of the cable. In contrast, the grounding cable 1*d* of the present invention suppressed the resonance by the consumption of the standing wave of the high-frequency noise by the carbon fiber.

Similar results were obtained from the cables having a constitution different from that shown in FIG. 5.

The electric resistance R and inductance L are controlled to satisfy the aforementioned formula: $2\pi fL/R \leqq 1$, in the following manner.

The resonance of the aforementioned high-frequency noise occurs when the length l (small letter of L) coincides with integral multiples of $\lambda/4$, wherein $\lambda$ is the wavelength of the high-frequency noise that flows through the cable having a length of l (small letter of L), an odd multiple means series resonance and even multiple means parallel resonance. To suppress the resonance of a high-frequency noise, resistance R of the conductive material is connected to meet $2\sqrt{(L/C)} \leqq R$ in the case of series resonance and resistance R of the conductive material is connected to meet $1/2\sqrt{(L/C)} \geqq R$ in the case of parallel resonance. The electric resistance R of this conductive material is connected by the method described in the above-mentioned examples for adjustment of electric resistance R. As used herein, C is a capacitance of the length of the cable l (small letter of L).

While a carbon fiber was used as a non-metallic conductive material having a slight electric resistance in the above-mentioned embodiments, it is not restricted to a carbon fiber, but instead, a carbon powder, a resin layer or a resin, the layer and tape containing a carbon powder, carbon particles, a carbon short fiber, or mixture of these, can be used. In addition, while the grounding cable comprises a flat type cable, coil-like cable and the like as the conductor, it is not an element of the present invention. Further, a cable having controlled internal inductance L of the metal conductor and resistance R of the carbon fiber, and a cable having a different combination of the external inductance of the metal conductor and resistance R of the carbon fiber have been employed as the grounding cables, but these are not elements of the present invention.

According to each invention as defined in the claims, since high-frequency noise is consumed by a slight electric resistance of the non-metallic conductive material disposed on the outer periphery of the conductor of the grounding cable, resonance of the high-frequency noise generated in various electronic devices in an office building and the like can be extremely easily reduced. Consequently, various disadvantages due to high-frequency noise can be avoided.

According to the inventions as defined in claims 2 and 6, since the slight electric resistance R of the non-metallic conductive material is set with regard to inductance L of the metal conductor to satisfy the formula: $2\pi fL/R \leqq 1$, reduction of the resonance of a high-frequency noise can be ensured.

This application is based on application Nos. 301754/1998 and 212387/1996 filed in Japan, the contents of which are incorporated hereinto by reference.

What is claimed is:

1. A grounding cable for use in preventing a high frequency noise that is generated from an electronic device, would remain in the grounding cable, and is transmitted to electric devices, said grounding cable comprising:

a conductor, having an inductance L; and a non-metallic conductive material, having a small electric resistance R, disposed, directly or via an insulating layer, on said conductor, electrically contacting said conductor, and operable to consume the high-frequency noise flowing on a surface of said conductor via the electric resistance of said non-metallic conductive material by virtue of a skin effect;

wherein when said non-metallic conductive material is disposed on said conductor via said insulating layer, said conductor and said non-metallic conductive material electrically contact each other at two points spaced apart in a longitudinal direction of said conductor; and wherein the electric resistance R of said non-metallic conductive material and the inductance L of said conductor satisfy the formula: $2\pi fL/R \leqq 1$ where f is a resonance frequency of the high-frequency noise.

2. The cable of claim 1, wherein said non-metallic conductive material is applied to a periphery of said conductor or disposed in a longitudinal direction of said conductor in the form of a tape.

3. The cable of claim 1, wherein said non-metallic conductive material comprises an insulating layer formed on the outside of said non-metallic conductive material.

4. A method for use with a grounding cable having a conductor and for use in preventing a high-frequency noise that is generated in an electronic device, remains in the grounding cable as a standing wave, and is transmitted to electric devices, said method comprising:

disposing, directly or via an insulating layer, a non-metallic conductive material having a slight electric resistance R on the conductor of the grounding cable;

selecting the electric resistance R of the non-metallic conductive material and inductance L of the conductor so as to satisfy the formula: $2\pi fL/R \leqq 1$ where f is a resonance frequency of the high-frequency noise; and consuming the high-frequency noise flowing on a surface of the conductor via the electric resistance of the non-metallic conductive material by virtue of a skin effect, so as to reduce resonance of the high-frequency noise;

wherein when the non-metallic conductive material is disposed on the conductor via the insulating layer, the conductor and the non-metallic conductive material are brought into electrical contact with each other at two points spaced apart in a longitudinal direction of the conductor.

5. The method of claim 4, wherein the non-metallic conductive material is disposed by coating a periphery of the conductor of the grounding cable with the non-metallic conductive material or disposing a tape-like non-metallic conductive material in the longitudinal direction of the conductor of the grounding cable.

6. The method of claim 4, wherein the non-metallic conductive material is disposed by applying an insulating layer to the outside of the non-metallic conductive material.

* * * * *